United States Patent [19]

Martinez

[11] 4,329,786

[45] May 18, 1982

[54] BRICKLAYER'S PLUMB GUIDE

[76] Inventor: James V. Martinez, 177 W. 250 North, (Apt. #1), Clearfield, Utah 84015

[21] Appl. No.: 101,710

[22] Filed: Dec. 10, 1979

[51] Int. Cl.[3] ..... G01C 15/10

[52] U.S. Cl. ..... 33/409

[58] Field of Search ..... 33/404, 406–410, 33/339, 1 LE, 369, 137; 24/136 R, 137 R; 43/44.91

[56] References Cited

U.S. PATENT DOCUMENTS

| | | | |
|---|---|---|---|
| 1,122,359 | 12/1914 | Bissett | 43/44.91 |
| 2,807,907 | 10/1957 | Brite | 43/44.91 |
| 2,829,464 | 4/1958 | Pettit | 43/44.91 |
| 3,145,499 | 8/1964 | Stoll | 43/44.91 |
| 3,250,009 | 5/1966 | Oseka | 33/404 |

FOREIGN PATENT DOCUMENTS

| | | | |
|---|---|---|---|
| 30048 | of 1910 | United Kingdom | 33/137 R |

*Primary Examiner*—Charles E. Phillips
*Attorney, Agent, or Firm*—A. Ray Osburn

[57] ABSTRACT

A plumb guide for facilitating the laying of end bricks or other masonry units of a tier successively in true vertical alignment without the use of spirit levels and the like. The guide is adapted to be removably attached at selectable points on the usual bricklayer's gage line. A flat surface of the guide is disposed perpendicularly to the gage line, serving as a reference for the placement of end units in successive layers about windows, fireplaces and the like.

4 Claims, 6 Drawing Figures

BRICKLAYER'S PLUMB GUIDE

BACKGROUND OF THE INVENTION

1. Field

The field of the invention is devices to aid in masonry work and more particularly devices to aid in vertical alignment of the intermediate ends of walls and the like during construction.

Prior Art

Construction of wall openings for the framing of windows, doors, fireplaces and the like, is often required in brick laying and other masonry work. Bricklayers' spirit levels are commonly used to place the facing masonry units of such openings in vertical alignment, and a bricklayer's gage line to place such units vertically. With this method, the bricklayer must simultaneously place the brick, hold a lengthy level in the vertical position and observe its indicator to assure it is vertical, a process which is cumbersome and of doubtful accuracy. The spirit level is bulky, fragile and expensive, often being lost or broken when stored and carried from one point of use to another. A particularly skilled bricklayer may on occasion simply visually sight in, or "eyeball" the vertical alignment of the end bricks. This method may produce satisfactory results for smaller openings, but is unreliable, especially for the larger openings generally required.

Numerous devices have been developed for the securing of the gage line, represented by such U.S. Pat. Nos. as 995,714, 1,075,166, and 4,084,321. A plumbing device for the primary ends of masonry walls is represented by U.S. Pat. No. 402,360. However, these prior art devices do not address the above mentioned need for a simple, economical, rugged device for plumbing intermediate wall openings, which appears to have been heretofore neglected in the art.

SUMMARY OF THE INVENTION

The plumb guide comprises a device to aid bricklayers and other masonry workers in the construction of brick walls and the like. The plumb guide is adapted to be readily attached at required locations to a stretched bricklayer's gage line, and enables the bricklayer to very readily and accurately vertically align facing end bricks for windows, doors and other wall openings. According to one embodiment, a flat end face of the plumb guide extends perpendicularly from the line to define the vertical plane for placement of the faces of the bricks forming the opening in each successive row of bricks as the wall is upwardly constructed. The body is slotted or otherwise adapted to accept the gage line to position the plumb guide so that the flat face is normal to the gage line. Means are provided to retain the guide upon the line and to enable it to be readily attached and detached. Numerous means of detachably securing the guide may be devised without essentially changing the plumb guide.

It is a principal object of the invention to provide an economical, extremely portable means facilitating the plumb alignment of end facing masonry units with improved accuracy over prior methods, obviating the necessity for use of cumbersome, expensive and fragile spirit levels and the like.

DETAILED DESCRIPTION OF ILLUSTRATED EMBODIMENTS

Figure 1:
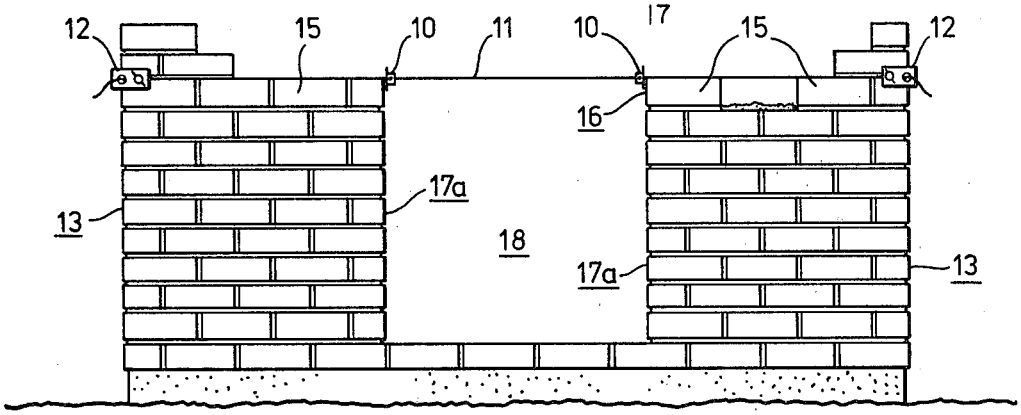
FIG. 1 is a simplified illustration of two of the plumb guides embodied according to the invention attached to a bricklayer's gage line in the manner of their use, a brick wall with a door opening being shown in the process of being constructed.

Two of the plumb guides, generally 10, are shown in FIG. 1 attached to a bricklayer's gage line 11, which is a nylon cord or the like. Gage line 11, after its normal mode of use, is held in tensioned, unsagging horizontal position by line blocks 12 which engage ends 13 of a wall 14, shown in FIG. 1 during construction. Gage line 11 serves as a guide for placing of bricks 15 of the row being constructed each at proper height and properly aligned vertically with previously placed lower brick layers of wall 14. Plumb guides 10 serve to locate an end face 16 of end brick 17 of the row being constructed plumb with corresponding end faces of previously laid lower end bricks forming vertical faces 17*a* of an opening 18 being formed in wall 14. Such openings 18 are frequently required for fireplaces, piers, horns, doors, and windows. As the laying of each row of bricks is completed, gage line 11, along with attached plumb guides 10, is moved directly vertically upward into position to guide the placement of the next higher row.

Figure 2:
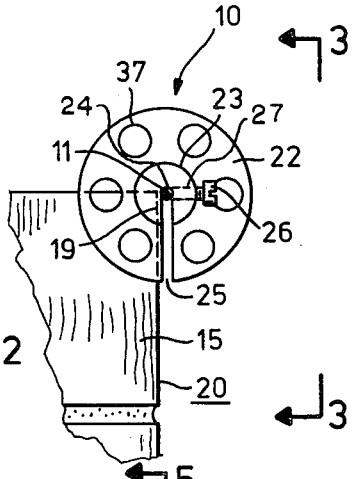
FIG. 2 is a generally full scale end view representation of a plumb guide embodiment according to the invention installed upon a gage line, the spacial relationship of the guide, a gage line, and an end brick of a layer being indicated.
Figure 3:
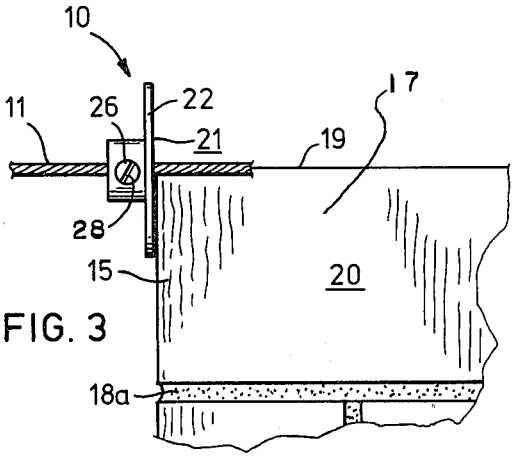
FIG. 3 is a side view representation of the guide, line and end brick as seen along line 3—3 of FIG. 2.

As best seen in FIGS. 2 and 3, plumb guide 10 carries a vertical flat face 21 disposed normally to horizontal gage line 11. The bricklayer settles end brick 17 into mortar 18*a* with end face 16 of brick 15 in neutral contact with face 21 of guide 10, and with top edge 19 at the elevation of line 11. Face 20 is thus vertically aligned with the wall side of line 11.

Flat face 21 of plumb guide 10 is carried by a circular disc portion 22 having a central boss 23 extending axially from disc 22 and oppositely from face 21. Bore 24, generally of the diameter of gage line 11, is provided axially throughout disc 22 and boss 23 and assures that face 21 is perpendicular to line 11. Radial slot 25 connects with bore 24, so that plumb guide 10 may be readily attached or detached from, and located longitudinally to, line 11. Set screw 26 in a threaded side bore 27 in boss 23 serves to secure plumb guide 10 to line 11. For convenience, screw 26 may be selected with a head slot 28 which may be engaged by the tip of a bricklayer's trowel. Disc 22 may carry perforations 37 to minimize the mass of plumb guide 10, so that line 11 does not sag to any significant degree under its weight. For the same purpose, plumb guide 10 may be constructed of light weight metals or rigid plastics, although the small size of plumb guide 10 generally precludes any significant depression of gage line 11.

The designer may vary many specific structural details of plumb guide 10 without departing from the essence of the invention. For example, radial slot 25 may be dispensed with, with gage line 11 being threaded through bore 24, the plumb guide then being generally permanently installed on line 11, and moved and secured at various longitudinal locations on line 11 as needed. However, complete detachment of plumb guide 10 is often necessary, such as when wall 14 has no intermediate openings 18. Many diverse means for ready attachment and detachment of plumb guide 10 may be readily devised, such as the use of spring clips to frictionally engage line 11, or serpentine or other string friction designs of bore 24.

Figure 4:
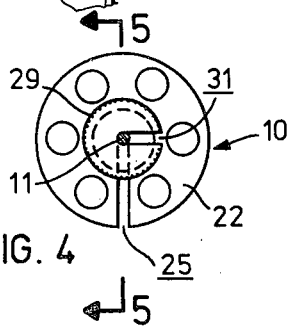
FIG. 4 is a generally full scale end view of another embodiment of the plumb guide according to the invention, being attached to a gage line, showing another means of removable attachment of the guide to the gage line.
Figure 5:
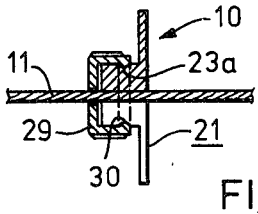
FIG. 5 is a side view cross-sectional representation of the line and guide of FIG. 4, as seen along line 5—5 thereof.
Figure 6:
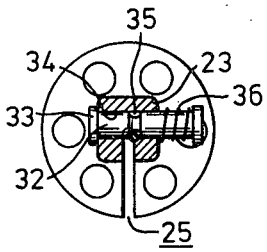
FIG. 6 is a transverse cross-sectional representation of a further embodiment of the plumb guide according to the invention, showing in particular a further means of removable attachment of the guide to the gage line.

Two illustrative examples of alternate mechanical attachment means are shown in FIGS. 4, 5 and 6. FIGS. 4 and 5 represent an attachment means utilizing a slotted, snap-on rotatable knurled cap 29 with an internal circumferential protrusion 30 in friction engagement with an outer circumferential groove 23*a* around boss 23. Cap slot 31 may be mismatched slightly with respect to bore 24, so that line 11 is pinched when cap 29 is manually rotated to a position such as shown in FIG. 5. FIG. 6 illustrates a spring loaded pin 32 with swaged pin-retaining end 33 installed in an unthreaded cross bore 34 in boss 23. Circumferential notch 35 in pin 32 engages line 11 under force of a compression coil spring 36, which is manually depressed to insert line 11 into notch 35.

Plumb guide 10 is illustrated with the flat guiding face 21 being of circular shape and extending generally radially from line 11. A portion of face 21 is thus always in position to guide placement of end brick 17 regardless of the plumb guide 10's angular orientation with respect to gage line 11. However, face 21 may be shaped variously and still perform its essential function. Although desireable, it is not essential that it extend in several directions from line 11, so long as at least one point of contact for end brick 17 is provided. For example, a single knife edge normal to line 11 would suffice, as would an arcuate or circular rim in a plane normal to line 11.

The embodiments shown and described herein are for illustrative purposes only, and other embodiments may be utilized without departing from the essential spirit of the invention. All embodiments within the length and breadth of the appended claims, and all equivalents thereof, are intended to be embraced therein:

I claim:

1. A bricklayer's plumbing apparatus comprising:

a bricklayer's gage line;

line block means for holding the gage line in tensioned horizontal position; and a plumb guide comprising a guide body having a planar end portion disposed normal to said gage line, a longitudinal bore extending normal to said end portion and through the center thereof, and adapted to accept the bricklayer's gage line, means for attaching and removing the guide body to the gage line in a direction normal to said line, and means to lock said body in a desired position along said line, wherein in use the end face of a brick to be layed is brought into contact with said planar end portion while the top of said brick touches said line to provide a guide for vertical construction of a brick wall.

2. The apparatus of claim 1, wherein the means for attaching and removing the guide body comprises:

longitudinal slot means through the guide body connecting with the bore the full length thereof; and set screw means carried by the body and communicating with said bore.

3. The apparatus of claim 1 wherein the means for attaching and removing the guide body to the gage line comprises:

longitudinal slot means through the guide body connecting with the bore the full length thereof;

a slotted cap in frictional rotatable relationship about the guide body, so that the gage line in the longitudinal bore through the guide body may be pinched between longitudinal bore and the cap slot when the cap is rotated with respect to the guide body.

4. The apparatus of claim 1 wherein the means for attaching and removing the guide body to the gage line comprises:

longitudinal slot means through the guide body connecting with the bore the full length thereof;

a transverse bore through the guide body and communicating with the longitudinal bore through the guide body;

a cross pin in the transverse bore having a notch thereon adapted to accept a portion of the gage line;

means retaining the cross pin in the transverse bore; and spring means biasing the cross pin transverse to the longitudinal bore in the guide body, so that the gage line may be engaged within the notch and urged by the spring means against a side of the longitudinal bore through the body.

* * * * *